US009334554B2

(12) United States Patent
Kitamura et al.

(10) Patent No.: US 9,334,554 B2
(45) Date of Patent: May 10, 2016

(54) MAGNESIUM ALLOY SHEET

(75) Inventors: Takahiko Kitamura, Osaka (JP); Yukihiro Oishi, Osaka (JP); Nozomu Kawabe, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 186 days.

(21) Appl. No.: 13/382,826

(22) PCT Filed: Jun. 8, 2010

(86) PCT No.: PCT/JP2010/059711

§ 371 (c)(1), (2), (4) Date: Jan. 6, 2012

(87) PCT Pub. No.: WO2011/004672

PCT Pub. Date: Jan. 13, 2011

(65) Prior Publication Data

US 2012/0107171 A1 May 3, 2012

(30) Foreign Application Priority Data

Jul. 7, 2009 (JP) ..... 2009-161220

(51) Int. Cl.

| | |
|---|---|
| ***C22C 23/02*** | (2006.01) |
| ***C22F 1/06*** | (2006.01) |
| ***C22F 1/00*** | (2006.01) |

(52) U.S. Cl.

CPC . *C22F 1/06* (2013.01); *C22C 23/02* (2013.01); *C22F 1/00* (2013.01)

(58) Field of Classification Search

CPC ..... C22C 23/02; C22F 1/00; C22F 1/06
USPC ..... 420/404, 406
See application file for complete search history.

(56) References Cited

U.S. PATENT DOCUMENTS

| | | | | |
|---|---|---|---|---|
| 2005/0150577 | A1* | 7/2005 | Suzuki et al. | 148/420 |
| 2011/0003139 | A1* | 1/2011 | Numano et al. | 428/323 |
| 2012/0100035 | A1* | 4/2012 | Oishi et al. | 420/404 |

FOREIGN PATENT DOCUMENTS

| | | | |
|---|---|---|---|
| GB | 1470103 | A * | 4/1977 |
| JP | 06-256883 | A | 9/1994 |
| JP | 2006-144043 | A | 6/2006 |
| JP | 2006-144044 | A | 6/2006 |
| JP | 2006-144059 | A | 6/2006 |
| JP | 2006-144062 | A | 6/2006 |
| JP | 2006-152401 | A | 6/2006 |
| JP | 2007-098470 | A | 4/2007 |
| JP | 2008-163402 | A | 7/2008 |
| JP | 2008-308703 | A | 12/2008 |
| JP | 2009-007606 | A | 1/2009 |
| JP | 2009-120883 | A | 6/2009 |
| WO | WO 2009/001516 | A1 | 12/2008 |

OTHER PUBLICATIONS

NPL-1: Development of manufacturing process of wrought magnesium alloy sheets by twin roll casting, J. of achievements in materials and manufacturing engineering, vol. 20, issues 1-2, Jan. 2007, pp. 515-518.*

NPL: Mg alloy composition table, Wikipedia on-line dictionary under term "magnesium alloy" down-loaded on Sep. 17, 2013.*

NPI: Machine translation for JP2006144059 A, Aug. 2006.*

International Search Report for PCT/JP2010/059711 dated Sep. 21, 2010, pp. 1-3.

Office Action for Corresponding Chinese Application No. 201080028070.8, dated Oct. 29, 2013.

Watari et al. "Feasibility study of twin roll casting process for magnesium alloys", Journal of Materials Processing Technology, Dec. 31, 2007, vol. 192-193, pp. 300-305.

* cited by examiner

*Primary Examiner* — Jie Yang
(74) *Attorney, Agent, or Firm* — Ditthavong & Steiner, P.C.

(57) ABSTRACT

A magnesium alloy sheet having good press formability, a magnesium alloy structural member produced by pressing the sheet, and a method for producing a magnesium alloy sheet are provided. The magnesium alloy sheet is composed of a magnesium alloy containing Al and Mn. When a region from a surface of the alloy sheet to 30% of the thickness of the alloy sheet in a thickness direction of the magnesium alloy sheet is defined as a surface region and when a 200 $\mu m^2$ sub-region is arbitrarily selected from this surface region, the number precipitated impurity grains containing both Al and Mg and having a maximum diameter of 0.5 to 5 μm is 5 or less. When a 50 $\mu m^2$ sub-region is arbitrarily selected from the surface region, the number of crystallized impurity grains containing both Al and Mn and having a maximum diameter of 0.1 to 1 μm is 15 or less. In the grains of the crystallized phases, the mass ratio Al/Mn of Al to Mn is 2 to 5. The magnesium alloy sheet has good press formability since the crystallized phases and precipitates that cause breaking are small in amounts contained and in size.

14 Claims, No Drawings

MAGNESIUM ALLOY SHEET

TECHNICAL FIELD

The present invention relates to a magnesium alloy sheet suitable as a material for housings and various parts, a magnesium alloy structural member produced by press-forming the alloy sheet, and a method for producing a magnesium alloy sheet. In particular, it relates to a magnesium alloy sheet having good press formability.

BACKGROUND ART

Magnesium alloys containing magnesium and various additive elements are increasingly employed as materials for housings of mobile electronic devices such as cellular phones and laptop computers, and automobile parts.

Since magnesium alloys have a hexagonal crystalline structure (hexagonal close-packed (hcp) structure) and has low plastic formability at ordinary temperature, magnesium alloy structural members such as the housings described above are mainly formed of cast materials by a die casting method or a thixomolding method. Recently, studies have been made to form the housing by press-forming a sheet composed of an AZ31 alloy according to American Society for Testing and Materials (ASTM) standard. Patent literature 1 proposes a rolled sheet composed of an alloy equivalent to AZ91 alloy of the ASTM standard, the rolled sheet having good press formability.

RELATED LITERATURE

Patent Literature

PTL 1: Japanese Unexamined Patent Application Publication No. 2007-098470

SUMMARY OF INVENTION

Technical Problem

Further improvements on press formability are desired. Although patent literature 1 discloses a sheet having good press formability, the literature does not sufficiently examine its specific structure.

One of the objects of the present invention is to provide a magnesium alloy sheet having good press formability and a method for producing the sheet. Another object of the present invention is to provide a magnesium alloy structural member obtained from the magnesium alloy sheets of the present invention.

Solution to Problem

The inventors of the invention of this application have prepared magnesium alloy sheets under various conditions, subjected the resulting sheets to press-forming to study the condition such as breaking after the press-forming, and studied the structure of a magnesium alloy sheet on which press-forming could be satisfactorily conducted. As a result, they have found that a magnesium alloy sheet having good press formability contains crystallized phases having a particular composition and precipitates having a particular composition both of which are small in size and in amount contained, and that in order to achieve good press formability, the size and the amount of the crystallized and precipitates are preferably within a particular range. They have also found that, in producing such a magnesium alloy sheet, continuous casting is preferably conducted under particular conditions and the resulting cast sheet is preferably rolled under particular conditions to control the maximum diameter and the number of both crystallized phases and precipitates. The present invention has been made on the basis of these findings.

The magnesium alloy sheet of the present invention is composed of a magnesium alloy containing Al and Mn. When a region from the surface of the alloy sheet to 30% of the thickness of the alloy sheet in the thickness direction of the magnesium alloy sheet is defined as a surface region, and a 200 $\mu m^2$ sub-region (referred to as a "first sub-region" hereinafter) is arbitrarily selected from this surface region, the number of grains that are precipitates containing both Al and Mg and having a maximum diameter of 0.5 μm to 5 μm is 5 or less in the first sub-region. When a 50 $\mu m^2$ sub-region (referred to as a "second sub-region" hereinafter) is arbitrarily selected from the surface region, the number of grains that are crystallized phases containing both Al and Mn and having a maximum diameter of 0.1 to 1 μm is 15 or less in the second sub-region. In the grains of the crystallized phases, the mass ratio (Al/Mn) of Al to Mn is 2 to 5.

The magnesium alloy sheet of the present invention having a particular structure can be made by the following method of the invention, for example. The method for making a magnesium alloy sheet of the present invention includes the following casting step and a rolling step:

Casting step: step of casting a magnesium alloy containing Al and Mn into a sheet Rolling step: step of rolling the cast sheet obtained in the casting step.

In particular, the casting is conducted by a twin-roll continuous casting process. The casting is conducted at a roll temperature of 100° C. or less so that the thickness of the cast sheet obtained by the casting is 5 mm or less.

In addition, in the rolling step, the total length of time the material is retained in the temperature range of 150° C. to 250° C. is 60 minutes or less.

The magnesium alloy structural member of the present invention is formed by press-forming the magnesium alloy sheet of the present invention. This alloy structural member has the same structure as the magnesium alloy sheet. That is, the number of grains that are precipitates having the particular size and composition is 5 or less in a 200 $\mu m^2$ sub-region arbitrarily selected from the surface region and the number of grains that are crystallized phases having the particular size and composition is 15 or less in a 50 $\mu m^2$ sub-region arbitrarily selected from the surface region.

According to a continuous casting process such as a twin-roll continuous casting process capable of performing rapid solidification, the amounts of oxides and segregates can be reduced, generation of coarse crystallized phases can be suppressed, and fine crystallized phases can be formed. In particular, according to the production method of the present invention, the cooling rate is sufficiently increased by adjusting the roll temperature and the thickness of the cast sheet in the above-described particular ranges, and thus the generation of the crystallized phases itself can be suppressed. Accordingly, the structure of a surface-side region susceptible to breaking during press-forming can be turned into a structure containing few or substantially no fine crystallized phases. Presumably since the size and the amount of the crystallized phases are small, the decrease in the amount of dissolved Al in the matrix caused by coarse crystallized phases or large amounts of crystallized phases is suppressed, and the degradation of solution hardening associated with the decrease in Al content is suppressed. Moreover, rapid solidification gives a cast sheet having a fine structure with a small average crystal grain diameter. Such a cast sheet contains few or substantially no coarse crystallized phases that serve as starting points of breaking and deformation and thus has high plastic formability such as rolling. When the cast sheet is rolled, mechanical properties such as strength and elongation can be improved. In rolling the cast sheet, the number of coarse precipitates can be reduced by reducing the total length of time the material is retained in a particular temperature range compared to a conventional practice.

The invention alloy sheet obtained by the production method described above contains few coarse crystallized phases and precipitates that serve as starting points of breaking and the like, and the amounts of the crystallized phases and the precipitates are small. In particular, because the structure contains few coarse crystallized phases and precipitates and minute amounts of fine crystallized phases and precipitates in the surface-side region susceptible to breaking and cracking during press-forming, or because the structure contains substantially no crystallized and precipitates, breaking, cracking, and the like do not readily occur during press-forming Since the amounts of crystallized and precipitates is small, the decrease in dissolved Al content can be suppressed and a high strength can be maintained due to presence of a sufficient amount of dissolved Al. Accordingly, the invention alloy sheet can be sufficiently elongated by press-forming, can maintain high strength, and is not likely to suffer from breaking and cracking. Accordingly, the invention alloy sheet has good press formability. When the obtained alloy structural member of the present invention has a structure in which the amount and size of the crystallized and precipitates in the surface-side region are small as with the invention alloy sheet, the alloy structural member exhibits good mechanical properties such as strength, elongation, and impact resistance and can be suitably used as various housings and parts.

The present invention will now be described in detail.

<<Composition>>

Examples of the magnesium alloy constituting the invention magnesium alloy sheet and the invention magnesium alloy structural member include those having various compositions and containing at least Al and Mn as additive elements (balance being Mg and impurities). An example of the additive element other than Al and Mn is at least one element selected from Zn, Si, Ca, Sr, Y, Cu, Ag, Ce, Zr, and rare earth elements (excluding Y and Ce). In particular, 5% to 12% by mass of Al and 0.1% to 2.0% by mass of Mn are preferably contained. When Al and Mn are contained in these ranges, not only mechanical properties such as strength, elongation, and impact resistance is improved but also the corrosion resistance is improved. However, if the contents of these elements are excessively large, the decrease in plastic formability such as rolling and press-forming results. The contents of the additive elements other than Al and Mn are, for example, Zn: 0.2 to 7.0% by mass, Si: 0.2 to 1.0% by mass, Ca: 0.2 to 6.0% by mass, Sr: 0.2 to 7.0% by mass, Y: 1.0 to 6.0% by mass, Cu: 0.2 to 3.0% by mass, Ag: 0.5 to 3.0% by mass, Ce: 0.05 to 1.0% by mass, Zr: 0.1 to 1.0% by mass, and RE (rare earth element (excluding Y and Ce)): 1.0 to 3.5% by mass. When these elements are contained in addition to Al and Mn, the mechanical properties can be further enhanced. Examples of the compositions of the alloy containing Al, Mn, and at least one of these elements in amounts in the above-described ranges include AZ series alloys (Mg—Al—Zn series alloys, Zn: 0.2 to 1.5% by mass) and AM series alloys (Mg—Al—Mn series alloys, Mn: 0.15 to 0.5% by mass) of the ASTM standard. In particular, the amount of Al contained (hereinafter referred to as the "Al content") is preferably large since the mechanical properties and corrosion resistance improve with the increase in Al content, and the Al content is more preferably 5.8% by mass or more and 10% by mass or less. Preferable examples of the magnesium alloys having an Al content of 5.8% to 10% by mass include Mg—Al—Zn series alloys such as AZ61 alloys, AZ80 alloys, AZ81 alloys, and AZ91 alloys, and Mg—Al—Mn series alloys such as AM60 alloys and AM100 alloys. In particular, AZ91 alloys having an Al content of 8.3 to 9.5% by mass have superior corrosion resistance and mechanical properties such as strength and plastic deformation resistance compared to other Mg—Al series alloys and thus can be made into a magnesium alloy structural member having good mechanical properties.

<<Modes of Magnesium Alloy Sheet and Magnesium Alloy Structural Member>>

The invention alloy sheet has a first surface and a second surface that are a pair of surfaces opposing each other. These two surfaces are typically in parallel with each other and usually serve as a front surface and a back surface during the use. The first and second surfaces may be flat or curved. The distance between the first and second surfaces is the thickness of the magnesium alloy sheet. The invention alloy sheet is obtained by rolling a cast sheet having a thickness of 5 mm or less as described above; thus, the thickness of the invention alloy sheet is less than 5 mm. In particular, because the invention alloy sheet is press-formed and used as a material for thin, light-weight housings and various structural members, the thickness of the alloy sheet is about 0 3 mm to 3 mm and preferably 0.5 mm to 2.0 mm. The alloy sheet exhibits a high strength when the thickness is large within this range, and becomes suitable for use in thin, light-weight housings etc., when the thickness is small. The thickness of the magnesium alloy sheet obtained as a final product may be selected by controlling the casting conditions and rolling conditions in accordance with the desired usage.

Representative examples of the shape of the invention alloy structural member include various shapes formed by subjecting the magnesium alloy sheet to plastic forming such as press-forming, e.g., a square-bracket-shaped or box-shaped member having a bottom portion and a side wall portion extending upward from the bottom portion. The thickness of the magnesium alloy structural member in a flat portion not substantially subjected to deformation caused by press-forming is substantially the same as that of the magnesium alloy sheet used as the material although this depend on the conditions of press-forming, and the structure thereof also tends to be the same. In other words, the surface region in the flat portion satisfies that the number precipitates having a maximum diameter of 0.5 μm to 5 μm is 5 or less per 200 $\mu m^2$ and the number of Al—Mn crystallized phases having a maximum diameter of 0.1 to 1 μm is 15 or less per 50 $\mu m^2$.

Examples of the invention alloy sheet include a rolled sheet prepared by rolling a cast material, a heat-treated sheet prepared by heat-treating the rolled sheet, a polished sheet prepared by polishing the rolled sheet or the heat-treated sheet, a corrected sheet prepared by correcting the rolled sheet with a correcting apparatus such as roll leveler, and a polished sheet prepared by polishing the corrected sheet. The invention alloy sheet may be a rolled sheet or a heat-treated sheet with a recrystallized structure generated by heat-treating the rolled sheet; however, in such cases, strains may accumulate in the sheet during warm press-forming and work-hardening may occur in the sheet due to an increased dislocation density depending on the shape of the structural member, possibly resulting in fracture of the sheet. In contrast, when the rolled sheet is subjected to the correction treatment in a heated state without performing a final warm treatment after rolling so as to impart strain to the material and cause recrystallization during warm press-forming, a large elongation easily occurs during the press-forming, the breaking may be suppressed, and the press formability can thereby enhanced. The process of the rolling step can be selected in accordance with the shape of the structural member. The invention alloy structural member may be a structural member prepared by press-forming the invention alloy sheet and a structural member prepared by heat-treating or polishing the press-formed alloy sheet. The alloy sheet and the alloy structural member may further include a corrosion resistant layer and/or a coating layer.

<<Mechanical Properties>>

The invention alloy sheet has not only good press formability but also good mechanical properties such as strength at ordinary temperature (about 20° C.) and elongation in a warm process (at about 250° C.). In particular, in a tensile test at ordinary temperature (specimen: Japanese Industrial Standard (JIS) 13B), the tensile strength is 300 MPa or more and the 0.2% proof stress is 250 MPa or more. In a notch tensile test at 250° C., the elongation is 20% or more. Since the elongation in a warm process at 250° C. is high, the invention alloy sheet can be sufficiently elongated when warm press-forming is conducted at about 250° C., and exhibits good press formability. Since the elongation in the notch tensile test in a warm process is high, the invention alloy sheet can be satisfactorily elongated even when surface defects are present. Accordingly, magnesium alloy structural members having various shapes can be produced by press-forming the invention alloy sheet. Note that, in the alloy structural member of the present invention, a flat portion (portion having a structure substantially the same as that of the material sheet) not substantially subjected to deformation due to plastic forming such as press-forming (e.g., deformation by drawing) also has a tendency to exhibit mechanical properties comparable to those of the invention alloy sheet.

<<Structure>>

<Precipitates>

When a sub-region is arbitrarily selected from a surface-side region of the invention alloy sheet and the structure thereof is observed, the structure includes substantially no coarse precipitates or crystallized phases but includes minute amounts of and preferably substantially no fine precipitates or crystallized phases. In particular, in a direction of the thickness of the alloy sheet, a region from the surface of the alloy sheet to 30% of the thickness of the alloy sheet is defined as a surface region, a 200 $\mu m^2$ first sub-region is arbitrarily selected from this surface region, and the grain diameters of all the precipitates found in one first sub-region are measured. When the maximum diameter is measured from each precipitated grain, the number of fine precipitates having a maximum diameter of 0.5 μm to 5 μm in the first sub-region is 5 or less. In other words, the invention alloy sheet has a structure in which the surface region is substantially free of coarse precipitates more than 5 μm in size, and if precipitates ever exist, those precipitates are fine and contained in the structure in minute amounts. When coarse precipitates more than 5 μm in size are present, they serve as starting points for breaking and the like, breaking and cracking easily occur, and the press formability is degraded. Thus, only precipitates having a maximum diameter of 5 μm or less are preferably present. Moreover, even when the precipitates have a maximum diameter of 0.5 to 5 μm, the number of starting points for breaking, cracking, etc., will increase and the press formability will be degraded if more than 5 such precipitates are present in a 200 $\mu m^2$ region. The press formability tends to improve as the number of grains of precipitates having a maximum diameter of 0.5 to 5 μm is decreased. Ideally, the number of such precipitates is zero. The precipitates are typically intermetallic compounds containing both Mg and Al, e.g., $Mg_{17}$—$Al_{12}$. Note that in the present invention, presence of superfine precipitates which are not likely to cause breaking, i.e., precipitates having a maximum diameter less than 0.5 μm, is allowable. However, the precipitates are preferably absent.

<Crystallized Phases>

A 50 $\mu m^2$ second sub-region is arbitrarily selected from the surface region of the invention alloy sheet and the grain diameters of all crystallized phases present in one second sub-region are measured. When the maximum diameter is measured from crystallized phases, the number of fine crystallized phases having a maximum diameter of 0.1 μm to 1 μm in the one second sub-region is 15 or less. In other words, the invention alloy sheet has a structure in which the surface region of the invention alloy sheet is substantially free of coarse crystallized phases more than 1 μm in size, and if crystallized phases ever exist, those crystallized phases are fine and contained in minute amounts. When coarse crystallized phases more than 1 μm in size are present, breaking and cracking easily occur and the press formability is low. When more than 15 crystallized phases having a maximum diameter of 1 μm or less are present in the second sub-region, the number of starting points for breaking and cracking increases, resulting in a decrease in strength and degradation of press formability. In other words, the press formability tends to improve as the number of grains of crystallized phases having a maximum diameter of 0.1 to 1 μm is decreased. The number of crystallized phases in the second sub-region is preferably 10 or less and ideally zero, i.e., crystallized phases are preferably absent. If the crystallized phases ever exist, the maximum diameter thereof is preferably 0.5 μm or less. Examples of the crystallized phases include those containing both Al and Mn. Note that in the present invention, presence of superfine crystallized phases which are not likely to cause breaking, i.e., crystallized phases having a maximum diameter less than 0.1 μm, is allowable. However, the crystallized phases are preferably absent as described above.

<Average Crystal Grain Diameter>

An example of the invention alloy sheet is one having a microstructure with a small average crystal grain diameter, i.e., 20 μm or less. As described above, a cast sheet having a microstructure is obtained by continuous casting under particular conditions, and a rolled sheet having the microstructure described above can be prepared by rolling the cast sheet under particular conditions. The invention alloy sheet having such a microstructure exhibits good mechanical properties such as strength and elongation, and press formability. In contrast, a corrected sheet obtained by correcting the rolled sheet has a structure in which crystal grain boundaries are not clear due to the remaining strain (shear zone) but exhibits good press formability by recrystallization during press-forming as described above. The magnesium alloy sheet having the microstructure and the invention alloy structural member made from the corrected magnesium alloy sheet can have a microstructure having an average crystal grain diameter of 20 μm or less and exhibit good mechanical properties such as strength and elongation as described above. The average crystal grain diameter is more preferably 0.1 to 10 μm.

[Production Method]

<<Casting>>

In the invention production method, a twin-roll continuous casting process is employed. In this casting, the temperature of the rolls used as a die is adjusted to 100° C. or less and the thickness of the cast sheet obtained thereby is adjusted to 5 mm or less. By decreasing the thickness of the cast sheet and the roll temperature, generation of crystallized phases caused by rapid solidification is suppressed and a cast sheet containing fewer crystallized phases that are small in size can be obtained. The roll temperature is adjusted to 100° C. or less by using rolls that can be subjected to forced cooling such as water-cooling. The lower the roll temperature and the thinner the cast sheet, the faster the cooling rate and more suppressed is the generation of the crystallized phases. Accordingly, the roll temperature is more preferably 60° C. or less and the thickness of the cast sheet is more preferably 4.0 mm or less. This casting step (including cooling step) is preferably conducted in an inert gas atmosphere to prevent oxidation of the magnesium alloy.

<<Solution Treatment>

The cast sheet is preferably subjected to a solution treatment to homogenize the composition. The solution treatment is preferably conducted at a retention temperature of 350° C. or more and more preferably 380° C. to 420° C. for 60 to 2400 minutes. The retention time is preferably increased with the Al content. In particular, in the cooling step from the retention temperature, the length of time the material is retained in the temperature range of 150° C. to 250° C. is preferably short. For example, the cooling rate in this temperature range is adjusted to 0.1° C./sec or more (retention time: about 16.6 min or shorter) and preferably 0.5° C./sec or more (retention time: 3.3 min or shorter). This cooling rate can be achieved by forced cooling such as water cooling and blasting. When the retention time in this temperature range is shortened as much as possible, precipitation of the precipitates can be suppressed and even when precipitation has occurred, growth into coarse grains can be effectively suppressed.

<<Rolling>>

The cast sheet or the sheet subjected to the solution treatment are subjected to rolling. Rolling is conducted while heating the material in order to enhance the rolling property. The rolling property is enhanced with the increase in the heating temperature, but seizure may occur at an excessively high temperature and the mechanical properties of the rolled sheet obtained after rolling may be degraded due to coarsening of the precipitates and crystal grains. Accordingly, the heating temperature for the material is preferably 200° C. to 400° C., more preferably 380° C. or less, and yet more preferably 230° C. to 360° C. The rolling property can be further enhanced by heating not only the material but also the rolling rolls. The heating temperature for the rolling rolls is preferably 150° C. to 300° C. The reduction ratio per pass is preferably 5 to 50%. When a plurality of passes (multi-pass) of rolling are conducted, the sheet can be reduced to a desired thickness, the average crystal grain diameter can be reduced, and the press formability can be enhanced. The controlled rolling disclosed in patent literature 1 may also be used in combination.

In the rolling step described above, the total length of time the material is retained in the temperature range of 150° C. to 250° C. is adjusted to be 60 minutes or shorter. For example, the retention time in that particular temperature range can be adjusted to be 60 minutes or shorter by decreasing the duration of heating the material, increasing the rolling rate (roll peripheral speed), and increasing the cooling rate in each pass of rolling. The larger the Al content, the more likely precipitates are generated or grown. Thus, the total amount of the retention time is preferably adjusted in accordance with the Al content. The total length of time is more preferably 45 minutes or shorter and particularly preferably 30 minutes or shorter.

An intermediate heat treatment may be conducted between rolling passes. The intermediate heat treatment reduces or eliminates the strain, residual stress, aggregation textures, and the like that have been introduced to the material by the rolling up to the intermediate heat treatment, and the rolling thereafter can be smoothly conducted. The intermediate heat treatment is preferably conducted at a retention temperature of 230° C. to 360° C. In particular, the intermediate heat treatment is preferably controlled so that in the cooling step from the retention temperature of the intermediate heat treatment, the length of time the material is retained in the temperate range of 150° C. to 250° C. is included in the 60 minutes described above.

After the rolling, for example, a final heat treatment may be conducted at a retention temperature of 300° C. or more to eliminate the work strain caused by rolling and to achieve complete recrystallization. In this final heat treatment also, the final heat treatment is preferably controlled so that in the cooling step from the retention temperature, the length of time the material is retained in the temperate range of 150° C. to 250° C. is included in the 60 minutes described above. Instead of conducting the final heat treatment after rolling, the rolled sheet under heating at 100° C. to 250° C. may be corrected with a roll leveler or the like to impart strain to the material and so as to achieve recrystallization by press-forming. In this correction treatment also, the correction treatment is preferably controlled so that the length of time the material is retained in the temperate range of 150° C. to 250° C. is included in the 60 minutes described above. In other words, the retention time in the temperature range of 150° C. to 250° C. in the rolling step includes the rolling, the intermediate heat treatment, the final heat treatment, and the correction treatment.

By conducting the rolling (including the intermediate heat treatment, the final heat treatment, the correction treatment, etc.), the structure can be converted to a rolled structure from a metal structure formed by casting. Furthermore, by conducting the rolling, a microstructure having an average crystal grain diameter of 20 μm or less can be formed, internal and surface defects such as segregation, shrinkage cavities, and pores generated by casting can be reduced, and a rolled sheet with an excellent surface texture can be obtained. Since the invention alloy sheet has few defects, it also has good press formability.

<<Press-Forming>>

The invention alloy structural member is obtained by press-forming (including blanking) the invention alloy sheet (including the sheet subjected to the heat treatment and/or the correction treatment described above) into a desired shape. When the press-forming is conducted by a warm process at 200° C. to 280° C., the invention alloy sheet is elongated sufficiently and can be deformed without breaking or cracking, and a magnesium alloy structural member having a desired shape can be obtained. Since press-forming is conducted in a warm process, the structure constituting the resulting magnesium alloy structural member is suppressed from turning into a coarse recrystallized structure. Accordingly, the invention alloy structural member has a fine recrystallized structure and has good mechanical properties and corrosion resistance. Note that in the press-forming, because the length of time the material is retained in the temperature range of 150° C. to 250° C. is very short, the retention time in that temperature range need not be controlled unlike the rolling process described above. A heat treatment or an anticorrosion treatment may be conducted or a coating layer may be formed after the press-forming The heat treatment after the press-forming is preferably controlled so as not to extend the retention time in the temperature range of 150° C. to 250° C.

ADVANTAGEOUS EFFECTS OF INVENTION

The invention magnesium alloy sheet has good press formability. The method for producing a magnesium alloy sheet of the present invention can produce the invention magnesium alloy sheet. The magnesium alloy structural member formed of the invention magnesium alloy sheet has good mechanical properties.

DESCRIPTION OF EMBODIMENTS

Embodiments of the present invention will now be described.

[Test Example 1]

Ingots (commercially available products) composed of magnesium alloys shown in Table I were used to produce magnesium alloy sheets under various conditions, and the structure of the resulting magnesium alloy sheets was observed and a tensile test (ordinary temperature), a notch tensile test (250° C.), and evaluation of press formability were conducted. The production conditions were as follows.

(Condition A: Twin-roll Casting→Rolling)

Each of the ingots of magnesium alloys is heated to 700° C. in an inert atmosphere to prepare molten metal, and the molten metal is used to form a plurality of cast sheets each 4.0 mm (<5 mm) in thickness by a twin-roll continuous casting process in the inert atmosphere. This casting is conducted while cooling the rolls so that the roll temperature is 60° C. (<100° C.). Each of the resulting cast sheets is used as a material and rolled a plurality of times at a material heating temperature of 200° C. to 400° C., a rolling roll heating temperature of 150° C. to 300° C., and a reduction ratio per pass of 5% to 50% until the thickness of the material is 0.6 mm so as to prepare a rolled sheet. In particular, in this test, the rolling rate (roll peripheral speed) and the material heating time in each pass of rolling are adjusted so that the total time the material is retained in the temperature range of 150° C. to 250° C. is the length of time indicated in Table I. The resulting rolled sheets (magnesium alloy sheets) are used as samples.

A heat treatment (solution treatment) or aging treatment may be performed after the casting to homogenize the structure, an intermediate heat treatment may be performed during the rolling, or a final heat treatment may be performed after the final rolling. The rolled sheet may be subjected to a leveling process or a polishing process to improve the flatness by correction or may be polished to make the surface smooth. These also apply to Text Example 2 described below.

(Condition B: Extrusion→Rolling)

An commercially available extruded material is prepared and rolled under the same conditions as Condition A above. The resulting rolled sheet was used as a sample.

(Condition C: Commercially Available Sheet)

A commercially available sheet (thickness: 0.6 mm) composed of an AZ31 alloy is used.

<<Structural Observation>>

For each of the obtained samples, the metal structure was observed as below to study precipitates and crystallized phases. Each sample is cut in the thickness direction, and the section is observed with a transmission electron microscope (10,000 magnification). In this observed image, a region from the surface of the sample (sheet) to 30% (0.6 mm×30%=0.18 mm) of the thickness of the sample (sheet) in the thickness direction of the sample (sheet) is defined as a surface region. Five 200 $\mu m^2$ first sub-regions are arbitrarily selected from the surface region and the size of all precipitates found in each of the first sub-region is measured. Identification of the precipitates is conducted on the basis of the composition. After mirror-polishing the section, for example, the composition of the grains present in the section is determined by qualitative analysis and semiquantitative analysis such as energy dispersive X-ray spectroscopy (EDX), and grains containing Al and Mg are identified as precipitates. For each of the grains of the precipitates in the section, parallel lines are drawn in the section and the maximum value of the lengths of each grain traversing the straight lines is determined to be the maximum diameter of that grain. The number of precipitates having a maximum diameter of 0.5 μm to 5 μm is defined to be the number of precipitates in the first sub-region. The average number of the five first sub-regions is defined to be the number of the precipitates in this sample per 200 $\mu m^2$. Furthermore, five 50 $\mu m^2$ second sub-regions are arbitrarily selected from the surface region in the observed image, and the size of all crystallized phases present in each of the second sub-regions is measured as with the case of the precipitates. Identification of the crystallized phases is conducted on the basis of the composition as with the precipitates, and grains containing Al and Mn are identified to be the crystallized phases. The ratio of the mass of the Al to the mass of Mn (Al/Mn) was measured for each grain of the crystallized phases containing Al and Mn. The ratio Al/Mn of Sample 1-1 was 2 to 5. As with the case of measuring the maximum diameter of the precipitates described above, the maximum diameter of each grains of crystallized phases in the section is determined The number of the crystallized phases having a maximum diameter of 0.1 to 1 μm is defined to be the number of crystallized phases in the second sub-region, and the average number of five second sub-regions is defined to be the number of the crystallized phases of this sample per 50 $\mu m^2$. When coarse crystallized phases having a maximum diameter exceeding 5 μm are observed in the observed image, the area of the sub-region is changed to 200 $\mu m^2$ and the maximum diameter of the crystallized phases in this 200 $\mu m^2$ and the number of the crystallized phases per 200 $\mu m^2$ are measured. The shape of each sub-region may be any as long as the area satisfies the description above, but a rectangular shape (typically square) is easy to use. The measurement results are shown in Table I.

<<Tensile Test (Ordinary Temperature)>>

A JIS 13B sheet specimen (JIS Z 2201 (1998)) was taken from each sample (thickness: 0.6 mm) and subjected to a tensile test at ordinary temperature (about 20° C.) in accordance with a metal material tensile test method (gage length GL=50 mm, tensile speed: 5 mm/min) of JIS Z 2241 (1998) to measure the tensile strength (MPa) and the 0.2% proof stress (MPa) (number of evaluation: n=1 in all cases). The results are shown in Table I.

<<Notch Tensile Test (250° C.)>>

A JIS 13B sheet specimen (JIS Z 2201 (1998)) having a V notch (depth: 1 mm) having an angle of 45° was taken from each sample (thickness: 0.6 mm) The sample was subjected to a tensile test (gage length GL=50 mm, tensile speed: 5 mm/min) at 250° C. according to a metal material tensile test method described in JIS Z 2241 (1998) to measure the tensile strength (MPa) and elongation (%) (number of evaluation: n=1 in all cases). The results are shown in Table I.

<<Evaluation of Press Property>>

Both surfaces of each sample sheet were roughened with a #180 polish cloth to prepare a sheet with rough surfaces. The sheet was pressed and whether breaking occurred was observed with naked eye after pressing. The results are shown in Table I. More specifically, the roughened sheet was pressed at 250° C., and a box structural member having a square-bracket-shaped cross-section simulating a housing of a laptop computer was made. The rating ○ is given when the resulting pressed structural member has no breaking or rough surface.

TABLE I

| Sample No. | Alloy component | Production condition | Retention time in 150-250° C. (min) | Al—Mn crystallized impurities: Maximum diameter (μm) | Al—Mn crystallized impurities: Grains/50 μm² (*:Grains/200 μm²) | Al—Mg precipitated impurities: Maximum diameter (μm) | Al—Mg precipitated impurities: Grains/200 μm² | Tensile test: Tensile strength (MPa) | Tensile test: 0.2% proof stress (MPa) | Notch tensile test: Tensile strength (MPa) | Notch tensile test: Elongation (%) | Press formability |
|---|---|---|---|---|---|---|---|---|---|---|---|---|
| 1-1 | AZ91 | A | 45 | 0.4 | 10 | 1.3 | 3 | 370 | 315 | 65 | 33 | ○ |
| 101 | AZ91 | A | 90 | 0.4 | 11 | 1.5 | 12 | 346 | 306 | 74 | 13 | Breaking |
| 102 | AZ91 | B | 45 | 7 | 2* | 1.9 | 3 | 286 | 261 | 59 | 5 | Breaking |
| 103 | AZ31 | C | — | 13 | 1* | 0.2 | 2 | 285 | 242 | 70 | 16 | Breaking |

As shown in Table I, the magnesium alloy sheet in which the number of Al—Mg precipitates having a maximum diameter of 0.5 to 5 μm in a 200 μm² region arbitrarily selected from the surface region is 5 or less and the number of the Al—Mn crystallized phases having a maximum diameter of 0.1 to 1 μin a 50 μm² region arbitrarily selected from the surface region is 15 or less has good press formability. The reasons therefor are presumably that the elongation in the notch tensile test at 250° C. is as high as 33% and sufficient elongation can be achieved without breaking or cracking during warm press-forming According to Sample 1-1 having good press formability, neither Al—Mn crystallized phases having a maximum diameter exceeding 1 μm nor Al—Mg precipitates having a maximum diameter exceeding 5 μm were observed. Presumably such crystallized phases and precipitates are substantially absent at least in the surface region. Sample 1-1 having good press formability also has a high strength at ordinary temperature. In contrast, samples not produced under the particular production conditions and the commercially available products had a structure in which coarse precipitates and crystallized phases are present and a large number of precipitates are present in the surface region. Presumably, breaking readily occurred by press-forming due to the presence of such crystallized phases and precipitates. It has also been found that the commercially available products are inferior to Sample 1-1 also in terms of the strength at ordinary temperature.

A box structural member prepared by press-forming Sample 1-1 having good press formability and a box structural member prepared by press-forming a commercially available AZ31 alloy sheet in the same manner as Sample 1-1 were subjected to a Charpy test and a three-point bending test. The results are shown in Table II.

The Charpy test was conducted in accordance with JIS Z 2242 (2005) (rate of fall of a pendulum: 1.0 m/s, R.T., n=2). The absorbed energy (J/mm²) needed to break the specimen was measured. The average of n=2 is shown in Table II. Each specimen was prepared by cutting a flat bottom portion of a pressed structural member (not notched).

The three-point bending test was conducted in accordance with JIS Z 2248 (2006) (inter-span distance (distance between two supports): 60 mm, bending depth: 40 mm, indentation velocity: :5 mm/min, n=2). The pressing force of a pressing piece at which the specimen could be bent to a particular bending depth without breaking, i.e., the bending strength (MPa) was measured. The average of n=2 is shown in Table II. The specimen (No. 3 specimen) was prepared by cutting a flat bottom portion of each pressed structural member. Presence or absence of breaking was observed with naked eye.

TABLE II

| Sample No. | Alloy component | Production condition | Retention time in 150-250° C. (min) | Sample shape | Charpy test, absorbed energy (J/mm²) | Bending test: Bending strength (MPa) | Bending test: Breaking |
|---|---|---|---|---|---|---|---|
| 1-2 | AZ91 | A | 45 | Housing | 0.0673 | 364 | None |
| 104 | AZ31 | (Commercially available product) | — | Housing | 0.0583 | 255 | None |

As shown in Table II, the magnesium alloy structural member produced by press-forming a magnesium alloy sheet in which the number of Al—Mg precipitates having a maximum diameter of 0.5 to 5 μm in a 200 μm² region arbitrarily selected from the surface region is 5 or less and the number of the Al—Mn crystallized phases having a maximum diameter of 0.1 to 1 μm in a 50 μm² region arbitrarily selected from the surface region is 15 or less has high strength. Accordingly, this magnesium alloy structural member is expected to be suitable for use in various housings and parts.

[Test Example 2]

Ingots (commercially available products) composed of magnesium alloys shown in Table III were used to produce magnesium alloy sheets under various conditions. The structure of the resulting magnesium alloy sheets was observed and a notch tensile test (250° C.), and evaluation of press formability were conducted. The results are shown in Table III. The magnesium alloy sheets and prepared sheets were pressed at 250° C. to produce box structural members having a square-bracket-shape cross-section. The resulting box structural members were subjected to structural observation as with the magnesium alloy sheets. The results are shown in Table III.

As for the production condition "Casting→rolling", the casting is conducted by a twin-roll continuous casting process and the conditions of the roll temperature and the thickness of the cast sheet are set as shown in Table III. Rolling is conducted under the same rolling conditions as Test Example 1, and the length of time the material is retained in the temperature range of 150° C. to 250° C. is adjusted to the length of time shown in Table III to produce a rolled sheet (magnesium alloy sheet). As for the production condition "Die cast", the sample is a commercially available housing having a square-bracket-shaped cross-section, and "Condition B" and "Condition C" are the same as "Condition B: Extrusion→rolling" and "Condition C: Commercially available sheet" in Test Example 1.

In Table III, the shape described as "Sheet" represents that the sample is a magnesium alloy sheet, "Housing" represents that the sample is a magnesium alloy structural member formed by press-forming a magnesium alloy sheet.

Of these samples, the magnesium alloy sheets were subjected to the same structural observation as in Test Example 1. The structural observation of the magnesium alloy structural members (housings) and prepared housings was conducted by cutting a flat bottom portion of each housing and examining the section, as in Test Example 1. Of these samples, the magnesium alloy sheets was subjected to a notch tensile test (250° C.) to determine the elongation as in Text Example 1. The elongation of the magnesium alloy structural members (housings) and prepared housings in a notch tensile test (250° C.) was conducted by cutting a flat bottom portion of each housing and preparing a specimen from the bottom portion as in Test Example 1.

As shown in Table III, when a cast sheet having a thickness of 5 mm or less prepared by a twin-roll continuous casting process at a roll temperature of 100° C. or less is rolled so that the retention time in the temperature range of 150° C. to 250° C. is 60 minutes or less, a magnesium alloy sheet having a surface region structure in which the number of Al—Mg precipitates having a maximum diameter of 0.5 to 5 μm per 200 $\mu m^2$ is 5 or less and the number of the Al—Mn crystallized phases having a maximum diameter of 0.1 to 1 μm per 50 $\mu m^2$ is 15 or less can be obtained. When the roll temperature exceeds 100° C., when the thickness of the cast sheet exceeds 5 mm, or when the retention time in the temperature range of 150° C. to 250° C. in rolling is over 60 minutes, magnesium alloy sheets having small and few precipitates and crystallized phases cannot be obtained.

Also shown is that a magnesium alloy sheet in which the number of Al—Mg precipitates having a maximum diameter of 0.5 to 5 μm per 200 $\mu m^2$ is 5 or less and the number of the Al—Mn crystallized phases having a maximum diameter of 0.1 to 1 μm per 50 $\mu m^2$ is 15 or less has an elongation of 20% or more in the notch tensile test at 250° C. and thus has good press formability. A magnesium alloy structural member formed of such a magnesium alloy sheet having good press formability also has a surface region structure similar to that of the magnesium alloy sheet, i.e., a structure containing small and few precipitates and crystallized phases. Note that the Al/Mn of grains of the crystallized phases in Samples 2-1 to 2-10 was 2 to 5 in all samples.

In contrast, when a magnesium alloy sheet contains coarse precipitates and crystallized phases, e.g., crystallized phases more than 1 μm in size and precipitates more than 5 μm in

TABLE III

| | | | | Casting condition | | Reten- | Al—Mn crystallized impurities | | Al—Mg precipitated impurities | | |
|---|---|---|---|---|---|---|---|---|---|---|---|
| Sample No. | Alloy compo-nent | Sample shape | Production condition | Roll temper-ature (° C.) | Thick-ness (mm) | tion time in 150-250° C. (min) | Maxi-mum diameter (μm) | Grains/ 50 $\mu m^2$ (*: grains/ 200 $\mu m^2$) | Maxi-mum diameter (μm) | Grain/ 200 $\mu m^2$ | Press formability 250° C. elongation (%) |
| 2-1 | AZ91 | Sheet | Casting → rolling | 25° C. | 4 mm | 45 min | 0.3 μm | 8 | 1.3 μm | 3 | ○ (36%) |
| 2-2 | AZ91 | Housing | Casting → rolling | 25° C. | 4 mm | 45 min | 0.3 μm | 7 | 1.3 μm | 3 | — |
| 2-3 | AZ91 | Sheet | Casting → rolling | 60° C. | 2 mm | 45 min | 0.3 μm | 7 | 1.3 μm | 4 | ○ (39%) |
| 2-4 | AZ91 | Housing | Casting → rolling | 60° C. | 2 mm | 45 min | 0.3 μm | 7 | 1.3 μm | 3 | — |
| 2-5 | AZ91 | Sheet | Casting → rolling | 60° C. | 4 mm | 30 min | 0.4 μm | 10 | 1.2 μm | 2 | ○ (38%) |
| 2-6 | AZ91 | Housing | Casting → rolling | 60° C. | 4 mm | 30 min | 0.4 μm | 9 | 1.2 μm | 2 | — |
| 2-7 | AZ91 | Sheet | Casting → rolling | 60° C. | 4 mm | 45 min | 0.4 μm | 10 | 1.3 μm | 3 | ○ (33%) |
| 2-8 | AZ91 | Housing | Casting → rolling | 60° C. | 4 mm | 45 min | 0.3 μm | 8 | 1.3 μm | 3 | — |
| 2-9 | AZ91 | Sheet | Casting → rolling | 60° C. | 4 mm | 60 min | 0.4 μm | 9 | 1.3 μm | 5 | ○ (28%) |
| 2-10 | AZ91 | Housing | Casting → rolling | 60° C. | 4 mm | 60 min | 0.4 μm | 9 | 1.3 μm | 5 | — |
| 201 | AZ91 | Sheet | Casting → rolling | 60° C. | 4 mm | 90 min | 0.4 μm | 11 | 1.5 μm | 12 | × (15% – rough surface) |
| 202 | AZ91 | Housing | Casting → rolling | 60° C | 4 mm | 90 min | 0.3 μm | 10 | 1.4 μm | 11 | — |
| 203 | AZ91 | Sheet | Casting → rolling | 60° C. | 6 mm | 45 min | 3.5 μm | 4 | 1.3 μm | 4 | × (10% – rough surface) |
| 204 | A/91 | Housing | Casting → rolling | 60° C. | 6 mm | 45 min | 3.5 μm | 4 | 1.3 μm | 3 | — |
| 205 | AZ91 | Sheet | Casting → rolling | 120° C. | 4 mm | 45 min | 1.1 μm | 16 | 1.3 μm | 4 | × (11% – rough surface) |
| 206 | AZ91 | Housing | Casting → rolling | 120° C. | 4 mm | 45 min | 1.1 μm | 16 | 1.3 μm | 4 | — |
| 207 | AZ91 | Housing | Die casting | — | — | — | 15 μm | 1* | 12 μm | 2 | — |
| 208 | AZ31 | Sheet | C | — | — | — | 13 μm | 1* | 0.2 μm | 2 | × (16% – rough surface) |
| 209 | AZ31 | Housing | C | — | — | — | 11 μm | 1* | 0.2 μm | 2 | — |
| 210 | AZ91 | Sheet | B | — | — | 45 min | 7 μm | 2* | 1.9 μm | 3 | × (5% – breaking) |
| 211 | AZ91 | Housing | B | — | — | 45 min | 6 μm | 2* | 1.8 μm | 3 | — |
| 212 | AZ91 | Sheet | B | — | — | 90 min | 8 μm | 2* | 2.4 μm | 7 | × (3% – breaking) |
| 213 | AZ91 | Housing | B | — | — | 90 min | 7 μm | 2* | 2.3 μm | 7 | — |

size, or a large number of precipitates and crystallized phases, e.g., more than 15 crystallized phases having a maximum diameter of 0.1 to 1 μm per 50 $\mu m^2$ and more than 5 precipitates having a maximum diameter of 0.5 to 5 μm per 200 $\mu m^2$, the elongation of the magnesium alloy sheet is as low as 15% or less. Thus, breaking and rough surface occur after press-forming and the press formability is low.

It should be understood that the embodiments described above are subject various modification without departing from the scope of the present invention and the scope of the present invention is not limited by the structures described above. For example, the composition of the magnesium alloy, the thickness of the sheet after casting and after rolling, the roll temperature during casting, and the retention time in the temperature range of 150° C. to 250° C. during rolling may be modified as needed. The obtained rolled sheet or pressed structural member may be subjected to anticorrosion treatment or coated with a coating layer.

INDUSTRIAL APPLICABILITY

The magnesium alloy sheet of the present invention has good press formability and can thus be used as a material for a pressed structural members. The magnesium alloy structural member of the present invention is suitable for use in various housings and parts. The method for producing the magnesium alloy sheet of the present invention is suitable for production of the magnesium alloy sheet of the present invention.

The invention claimed is:

1. A magnesium alloy structural member produced by press-forming a magnesium alloy sheet, wherein the press-forming is conducted at a temperature in a range from 200° C. to 280° C., a heat treatment or an anti-corrosion treatment is conducted after the press-forming, and the magnesium alloy is in a temperature range of 150° C. to 250° C. for 60 minutes or less, including the heat treatment, the magnesium alloy sheet comprising:

a magnesium alloy containing Al and Mn, wherein:

when a region from a surface of the alloy sheet to 30% of the thickness of the alloy sheet in a thickness direction of the magnesium alloy sheet is defined as a surface region and when a 200 $\mu m^2$ sub-region is arbitrarily selected from this surface region, the number of grains that are precipitates containing both Al and Mg and having a maximum diameter of 0.5 to 5 μm is 5 or less, when a 50 $\mu m^2$ sub-region is arbitrarily selected from the surface region, the number of grains that are crystallized phases containing both Al and Mn and having a maximum diameter of 0.1 to 1 μm is 15 or less, in the grains of the crystallized phases, the mass ratio Al/Mn of Al to Mn is 2 to 5, the magnesium alloy contains 5% by mass to 12% by mass of Al and 0.1% by mass to 2.0% by mass of Mn, the magnesium alloy contains at least one element selected from the group consisting of Zn, Si, Ca, Sr, Y, Cu, Ag, Ce, Zr, and rare earth elements, excluding Y and Ce, and the magnesium alloy includes precipitates consisting of $Mg_{17}Al_{12}$.

2. The magnesium alloy structural member according to claim 1, wherein in a tensile test (specimen: JIS 13B) of the magnesium alloy sheet at ordinary temperature, the tensile strength is 300 MPa or more and the 0.2% proof stress is 250 MPa or more, and the elongation in a notch tensile test at 250° C. is 20% or more.

3. The magnesium alloy structural member according to claim 1, wherein the magnesium alloy sheet has a structure in which the region is substantially free of precipitates having a maximum diameter of more than 5 μm.

4. The magnesium alloy structural member according to claim 1, wherein the magnesium alloy further contains one or more of 0.2 to 7.0% by mass of Zn, 0.2 to 1.0% by mass of Si, 0.2 to 6.0% by mass of Ca, 0.2 to 7.0% by mass of Sr, 1.0 to 6.0% by mass of Y, 0.2 to 3.0% by mass of Cu, 0.5 to 3.0% by mass of Ag, 0.05 to 1.0% by mass of Ce, and 0.1 to 1.0% by mass of Zr.

5. The magnesium alloy structural member according to claim 1, wherein the magnesium alloy further contains 1.0 to 3.5% by mass of rare earth elements, excluding Y and Ce.

6. A method for producing a magnesium alloy sheet, the method comprising the steps of:

casting a magnesium alloy containing Al and Mn into a cast sheet;

rolling the cast sheet obtained by the casting step; and heat treating the cast sheet after the rolling step, wherein:

the casting is conducted by a twin-roll continuous casting process at a roll temperature of 100° C. or less and the thickness of the cast sheet is 5 mm or less, and the rolling and heat treating are conducted while heating the cast sheet and the total length of time the cast sheet being retained in a temperature range of 150° C. to 250° C. during rolling and heating treating is 60 minutes or less.

7. The method for producing the magnesium alloy sheet according to claim 6, wherein the casting is conducted at the roll temperature of 60° C. or less.

8. The method for producing the magnesium alloy sheet according to claim 6, wherein the rolling step is conducted with a temperature of the sheet being in a range from 200° C. to 400° C.

9. The method for producing the magnesium alloy sheet according to claim 8, wherein the rolling step is conducted with the temperature of the sheet being in a range from 230° C. to 360° C.

10. The method for producing the magnesium alloy sheet according to claim 8, wherein the rolling step is conducted with rollers at a temperature being in a range from 150° C. to 300° C.

11. The method for producing the magnesium alloy sheet according to claim 6, wherein, in the rolling step, the total length of time the material is retained in the temperature range of 150° C. to 250° C. is 45 minutes or less and the total length of time is adjusted based on an amount of the Al in the sheet.

12. The method for producing the magnesium alloy sheet according to claim 6, wherein the casting is conducted in an inert gas atmosphere.

13. The method for producing the magnesium alloy sheet according to claim 6, wherein the thickness of the cast sheet is 4 mm or less.

14. The method for producing the magnesium alloy sheet according to claim 6, wherein, in the rolling step, a reduction ratio per pass is 5 to 50% and a temperature of rollers is in a range from 150° C. to 300° C.

* * * * *